US008393481B2

(12) United States Patent
Denby et al.

(10) Patent No.: US 8,393,481 B2
(45) Date of Patent: Mar. 12, 2013

(54) CLOTHING DISPLAY FIXTURE

(75) Inventors: Scott E. Denby, Minneapolis, MN (US); Joseph R. Stukenberg, Minneapolis, MN (US); Judith A. Bell, Minnetonka, MN (US)

(73) Assignee: Target Brands, Inc., Minneapolis, MN (US)

( * ) Notice: Subject to any disclaimer, the term of this patent is extended or adjusted under 35 U.S.C. 154(b) by 199 days.

(21) Appl. No.: 12/829,482

(22) Filed: Jul. 2, 2010

(65) Prior Publication Data

US 2012/0000870 A1 Jan. 5, 2012

(51) Int. Cl.
*A47F 5/00* (2006.01)

(52) U.S. Cl. ..... 211/72; 211/85.3; 211/195

(58) Field of Classification Search ..... 211/72, 211/73, 85.3, 195; 206/278, 280, 292, 296, 206/297, 298, 299; 40/538, 539, 610; 383/127; 223/85, 87, 92; 229/4.5, 5.5; 248/200, 300, 248/213.2

See application file for complete search history.

(56) References Cited

U.S. PATENT DOCUMENTS

| | | | | | |
|---|---|---|---|---|---|
| 608,633 | A | | 8/1898 | Axene | |
| 886,524 | A | | 5/1908 | Litt | |
| 1,376,502 | A | * | 5/1921 | Bailey | 223/68 |
| 1,627,281 | A | * | 5/1927 | Garrety | 434/395 |
| 2,177,836 | A | * | 10/1939 | Messer et al. | 223/68 |
| 2,201,746 | A | | 5/1940 | Spencer | |
| 2,901,154 | A | * | 8/1959 | Baldwin | 223/68 |
| 3,354,576 | A | * | 11/1967 | Gralnick | 446/76 |
| 3,357,542 | A | * | 12/1967 | Aquino et al. | 206/279 |
| 3,699,598 | A | | 10/1972 | Struble | |
| 3,720,970 | A | | 3/1973 | Lutz | |
| 4,802,577 | A | * | 2/1989 | O'Leary | 206/278 |
| 4,944,042 | A | | 7/1990 | DeWan | |
| 5,165,567 | A | | 11/1992 | Richardson et al. | |
| 5,446,936 | A | | 9/1995 | Barger | |
| 5,557,870 | A | | 9/1996 | Bergman | |
| 5,562,229 | A | | 10/1996 | Callahan | |
| 5,718,331 | A | | 2/1998 | Smith | |
| 5,782,389 | A | * | 7/1998 | Maharg | 223/66 |
| 5,966,857 | A | * | 10/1999 | Pettersson et al. | 40/606.12 |
| 6,012,243 | A | | 1/2000 | Ledford | |
| 6,044,987 | A | | 4/2000 | Marcus et al. | |
| 6,382,433 | B1 | * | 5/2002 | Podergois | 211/195 |
| 7,121,027 | B1 | | 10/2006 | Sadallah | |
| 2009/0127215 | A1 | * | 5/2009 | Gale | 211/85.3 |
| 2010/0065450 | A1 | | 3/2010 | Plett | |

* cited by examiner

*Primary Examiner* — James O Hansen
*Assistant Examiner* — Sasha T Varghese
(74) *Attorney, Agent, or Firm* — Griffiths & Seaton PLLC

(57) ABSTRACT

A clothing display fixture includes a sleeve having an inner surface, an outer surface, a pair of opposing edges defining a top and a bottom, a joint, a first cross member and a second cross member. The first and second cross members have first lengthwise edges and opposing second lengthwise edges and first widthwise edges and opposing second widthwise edges. The first and second opposing widthwise edges are located adjacent to the inner surface of the sleeve such that the second widthwise edges span across the joint and wherein the first and second support members extend through a center of the sleeve.

18 Claims, 11 Drawing Sheets

CLOTHING DISPLAY FIXTURE

BACKGROUND

Retail establishments use a variety of product display structures to present products to guests for purchase. These product display structures support the product while making it easy for guests to reach and take the product for purchase at a cashier. Example product display structures include shelves, racks, peg hooks and other similar structures.

One exemplary way to present clothing on a product display structure is to hang clothes from hangers and place the hangers on a rack. In another example, clothes can be folded and stacked on a shelf. In either case, the customer will have to pick up the clothing and hold it up to get a better idea of what the product looks like.

Life-size mannequins or portions of mannequins have also been used to display clothing. However, such mannequins are large and expensive.

The discussion above is merely provided for general background information and is not intended to be used as an aid in determining the scope of the claimed subject matter.

SUMMARY

A product or clothing display fixture includes a sleeve, a first cross member and a second cross member. The sleeve has an inner surface, an outer surface, a pair of opposing edges defining a top and a bottom and a joint. Both the first and second cross members have first lengthwise edges, opposing second lengthwise edges, first widthwise edges and opposing second widthwise edges. The first and second opposing widthwise edges are each located adjacent to the inner surface of the sleeve such that the first widthwise edges span across the joint and the first and second cross members extend through a center of the sleeve. Clothing is displayed on the clothing display fixture by sliding fabric of the clothing over and around the sleeve such that the fabric covers the outer surface of the sleeve. Excess fabric is tucked into an opening at the top of the sleeve as defined by the top edge.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein include a clothing display structure or product fixture. The clothing display structure is made of three pieces of plastic sheeting and a plurality of fasteners. When assembled, the clothing display structure is able to receive a piece of clothing, such as a tee shirt, that can completely cover the display structure while at the same time displaying graphics on the front of the clothing.

Figure 1:
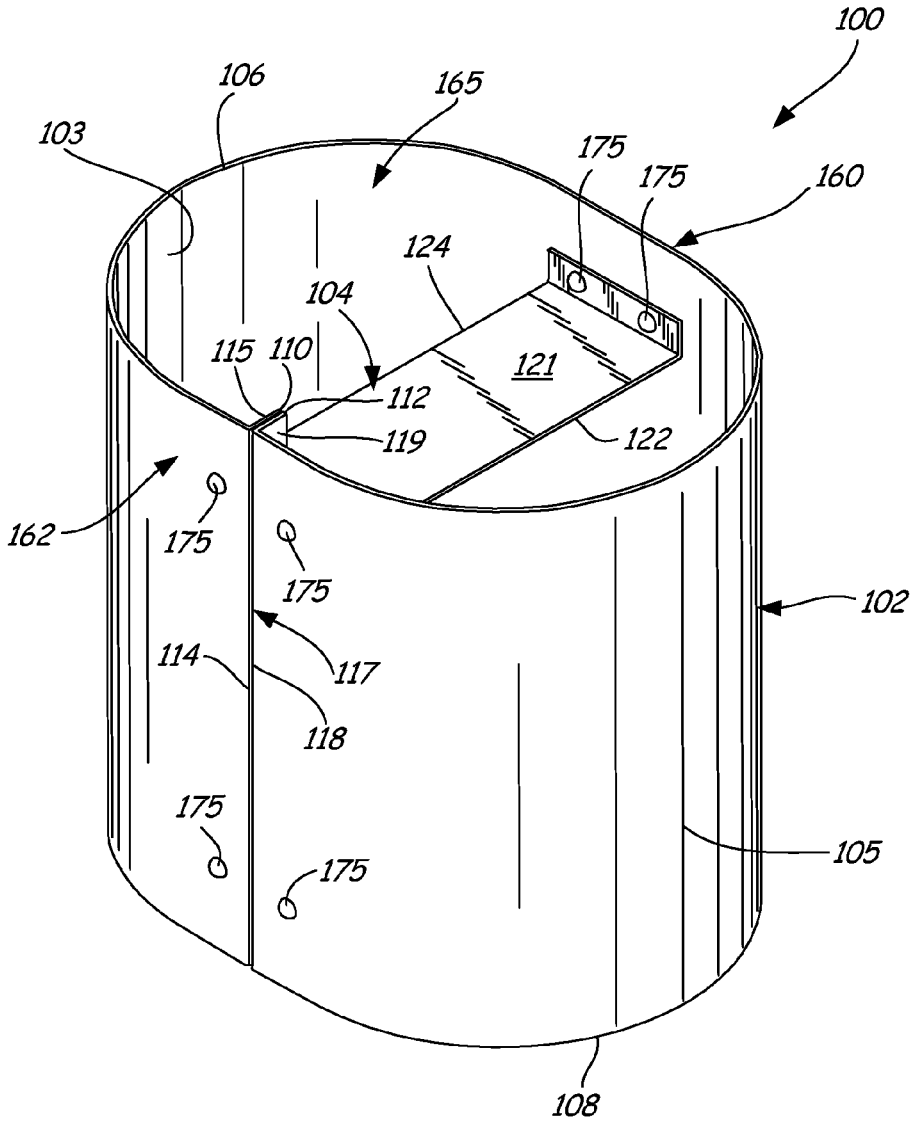
FIG. 1 is a perspective view of a clothing display fixture under one embodiment.

FIG. 1 illustrates a perspective view of an assembled product or clothing display fixture 100 under one embodiment. Clothing display fixture 100 includes a main body or sleeve 102 made of bendable plastic sheeting having a rectangular shape that has been bent to form a sleeve having two open ends, two planar sides and two curved sides. Main body 102 includes an interior or inner surface 103 and an exterior or outer surface 105. Clothing display fixture 100 also includes a first support member or cross member 104 (also illustrated in FIGS. 3 and 5-9) and a second support member or cross member (illustrated in FIGS. 4-8 and 10) made of plastic sheeting. Both support members are sized to couple opposing sides of main body or sleeve 102 and therefore define the two planar sides of the main body. The plastic sheeting of main body 102, first support member 104 and the second support member can be cold formed white styrene, for example, or any other suitable bendable material.

Figure 2:
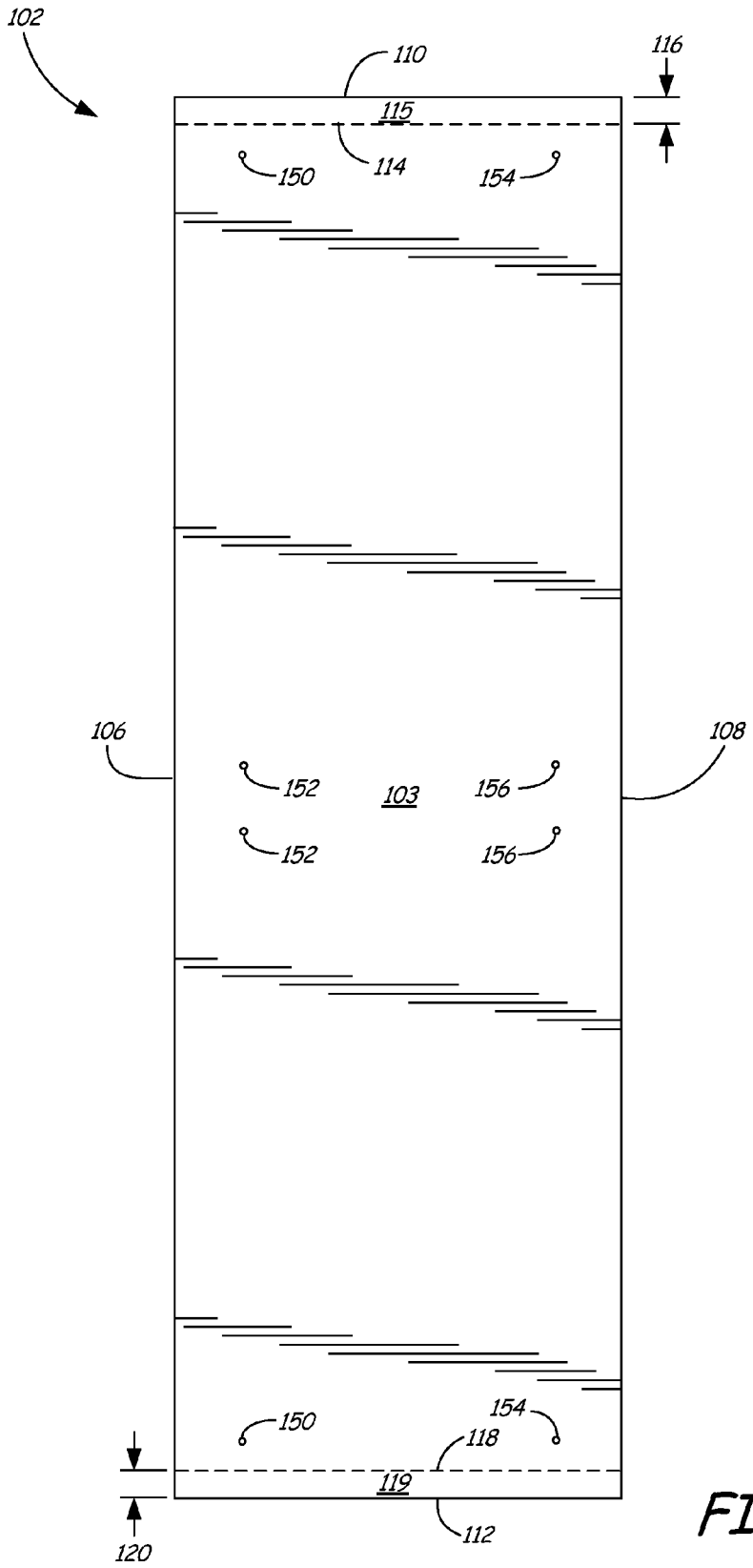
FIG. 2 illustrates a plan view of a main body or sleeve for the clothing display structure of FIG. 1 under one embodiment.

FIG. 2 illustrates a plan view of an interior or inner surface 103 of main body 102 before it is assembled into clothing display fixture 100 (FIG. 1). Main body 102 includes a pair of opposing lengthwise edges 106 and 108 and a pair of opposing heightwise edges 110 and 112 that intersect with and are substantially perpendicular to lengthwise edges 106 and 108. When main body 102 is assembled into clothing display fixture 100, lengthwise edge 106 defines a top edge or a bottom edge of clothing display fixture 100 and lengthwise edge 108 defines the other of the top edge or the bottom edge of the clothing display fixture. For example and as illustrated in FIG. 1, lengthwise edge 106 is the top edge of clothing display fixture 100 and lengthwise edge 108 is the bottom edge of the clothing display fixture. However, it should be realized that in the alternative, lengthwise edge 106 can be the bottom edge and lengthwise edge 108 can be the top edge. Likewise, when main body 102 is assembled into clothing display fixture 100, first heightwise edge 110 and second heightwise edge 112 define a height of the clothing display fixture.

As illustrated in FIG. 2, main body 102 includes a first heightwise bend line 114 that is parallel with and separated by a first distance 116 from heightwise edge 110 to form a first attachment allowance 115. Main body 102 also includes a second heightwise bend line 118 that is parallel with the first heightwise bend line 114 and separated by a second distance 120 from heightwise edge 112 to form a second attachment allowance 119. At first and second heightwise bend lines 114 and 118, the attachment allowances 115 and 119 are bent and oriented towards interior surface 103 and therefore out-of-plane from main body 102. For example, attachment allowances 115 and 119 can be oriented at a 90 degree angle from main body 102. As illustrated in FIG. 1, during the assembly of main body or sleeve 102, the exterior surfaces of attachment allowances 115 and 119 are brought together and held in place adjacent each other to form a joint 117 such that first heightwise bend line 114 and second heightwise bend line 118 are also held in place adjacent to each other.

Figure 3:
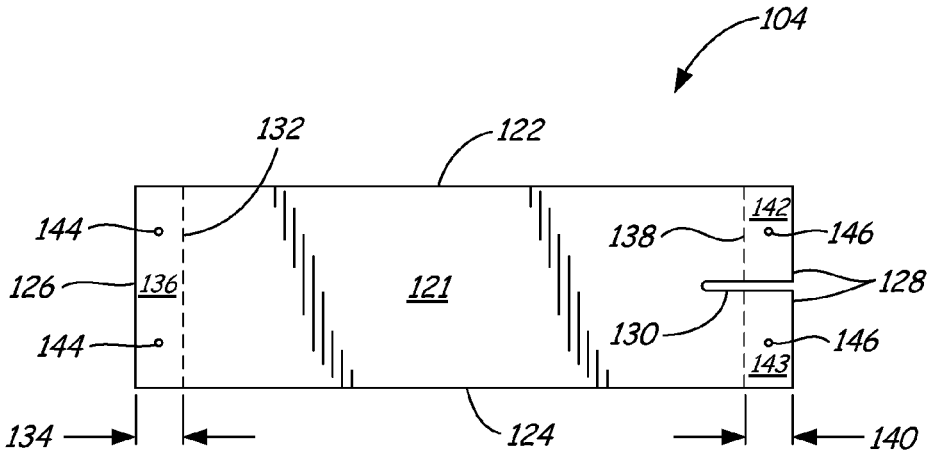
FIG. 3 illustrates a plan view of a first support member for the clothing display fixture of FIG. 1 under one embodiment.
Figure 4:
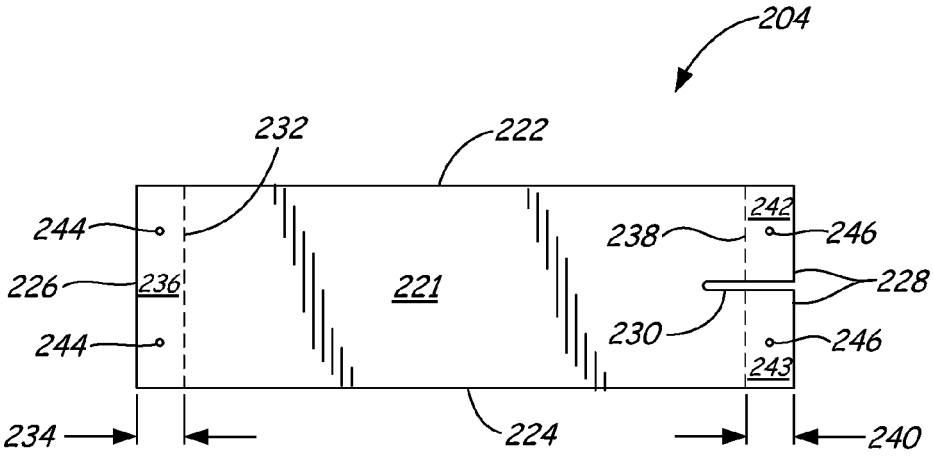
FIG. 4 illustrates a plan view of a second support member for the clothing display fixture of FIG. 1 under one embodiment.
Figure 5:
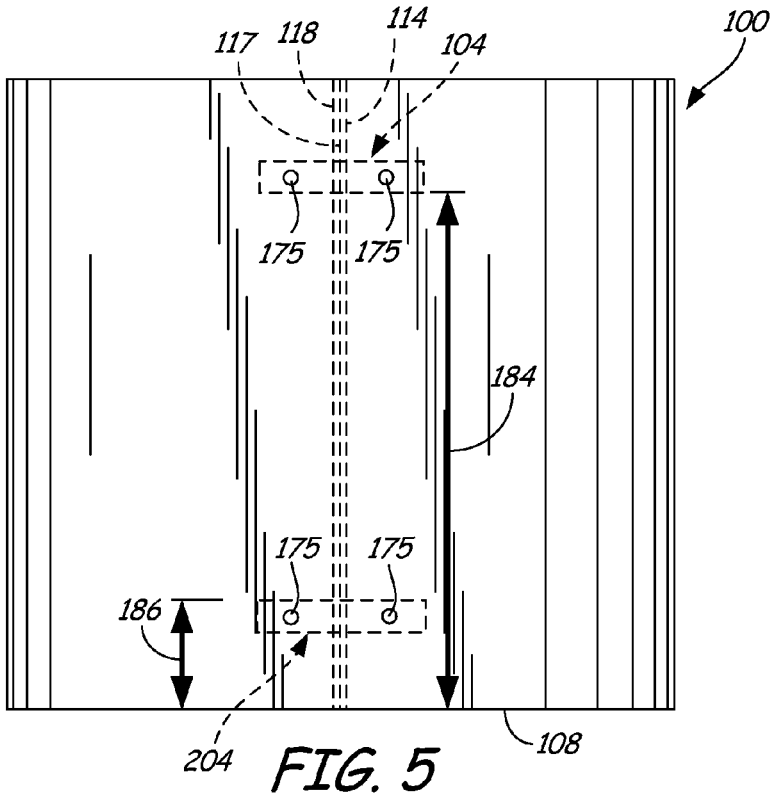
FIG. 5 is a front view of the clothing display fixture illustrated in FIG. 1.
Figure 6:
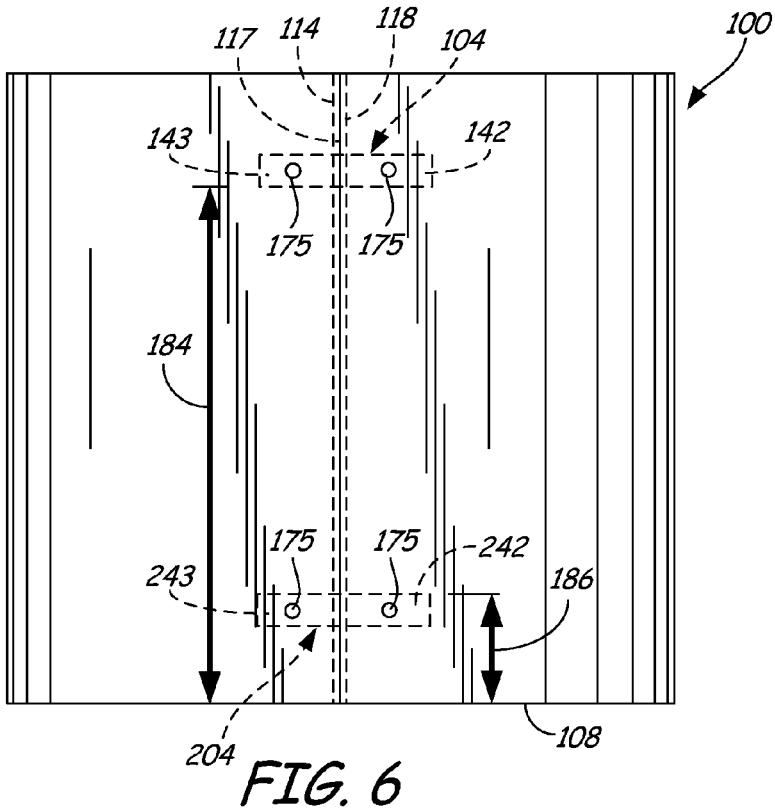
FIG. 6 is a back view of the clothing display fixture illustrated in FIG. 1.

FIG. 3 illustrates a plan view of an upper surface 121 of first support member 104 and FIG. 4 illustrates a plan view of an upper surface 221 of second support member 204. Both first and second support members 104 and 204 are for use in the assembled clothing display structure 100 as illustrated in FIG. 1. First support member 104 is viewable as assembled in FIG. 1 as well as illustrated in the top view of FIG. 9 and in phantom in FIGS. 5-8. Second support member 204 is illustrated in the bottom view of FIG. 10 as well as in phantom in FIGS. 5-8. It should be realized that first support member 104 and second support member 204 are substantially identical in structure before they are configured for assembly with main body 102.

As illustrated in FIGS. 3 and 4, first support member 104 and second support member 204 include a pair of opposing lengthwise edges 122, 222 and 124, 224. In addition, first support member 104 and second support member 204 include opposing widthwise edges 126, 226 and 128, 228. While both widthwise edges 126, 226 and 128, 228 intersect with lengthwise edges 122, 222 and 124, 224, only the entire width of first widthwise edges 126, 226 are substantially perpendicular to lengthwise edges 122, 222 and 124, 224. A portion of second widthwise edges 128, 228 are not substantially perpendicular to lengthwise edges 122, 224 and 124, 224. Rather, second widthwise edges 128, 228 include a slot portion 130, 230. Slot portions 130, 230 are for accommodating attachment allowances 115 and 119 of main body 102 when assembled into the clothing display structure 100.

As illustrated in FIGS. 3 and 4, first support member 104 and second support member 204 include first widthwise bend lines 132, 232 that are parallel with and separated by a first distance 134, 234 from widthwise edges 126, 226 to form first attachment allowances 136, 236. First support member 104 and second support member 204 also include second widthwise bend lines 138, 238 that are parallel with the first widthwise bend lines 132, 232 and separated by a second distance 140, 240 from portions of widthwise edges 128, 228 that are perpendicular to lengthwise edges 122, 222 and 124, 224 to form second attachment allowances 142, 242 and 143, 243. At first and second widthwise bend lines 132, 232 and 138, 238, the attachment allowances 136, 236; 142, 242; and 143, 243 are bent up or down (i.e., in either a direction into the page or out of the page) and therefore out-of-plane from first and second support members 104, 204, respectively, before being used in clothing display structure 100. For example, attachment allowances 136, 236; 142, 242; and 143, 243 can be oriented at approximately 90 degree angles from upper surfaces 121, 221, respectively. More specifically, however, attachment allowances 136, 142, and 143 of first support member 104 are bent out-of-plane from upper surface 121 such that widthwise edges 126 and 128 are located above upper surface 121 (illustrated in phantom in the side views of FIGS. 7 and 8). Attachment allowances 236, 242 and 243 are also bent out-of-plane from upper surface 221, but such that widthwise edges 226 and 228 are located below upper surface 221 (illustrated in phantom in the side views of FIGS. 7 and 8).

Figure 7:
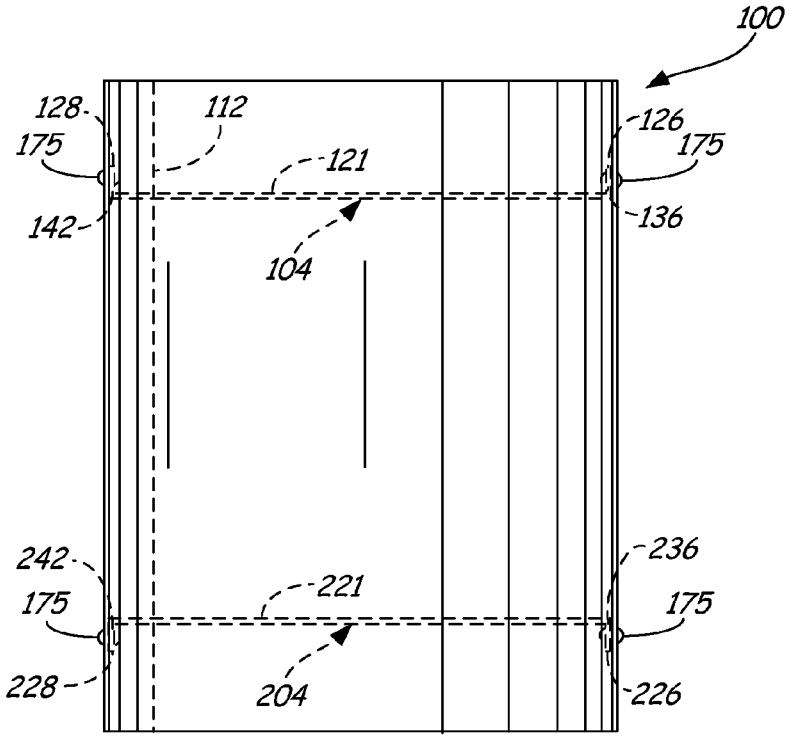
FIG. 7 is a left side view of the clothing display fixture illustrated in FIG. 1.
Figure 8:
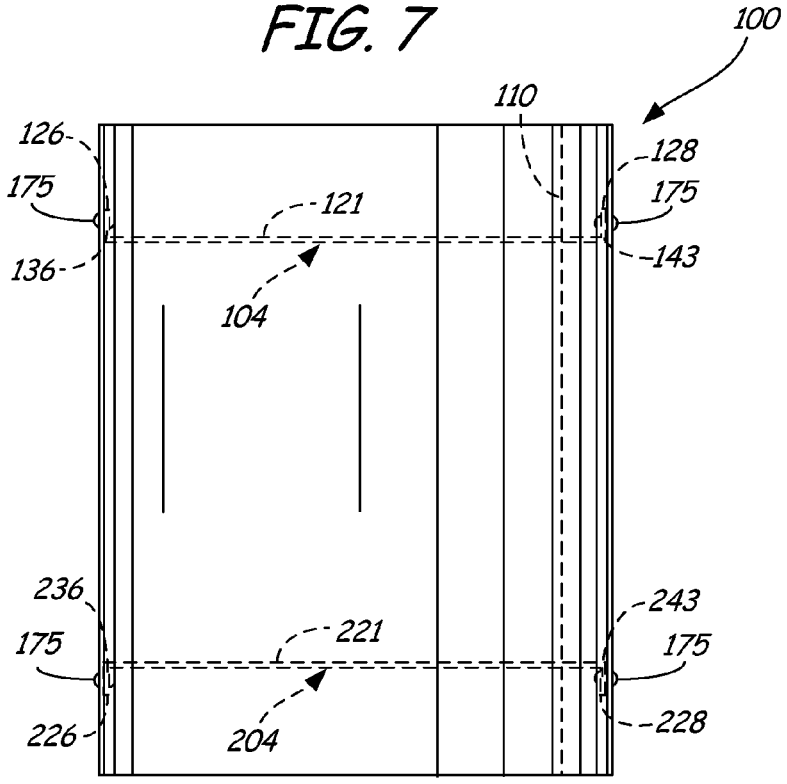
FIG. 8 is a right side view of the clothing display fixture illustrated in FIG. 1.
Figure 9:
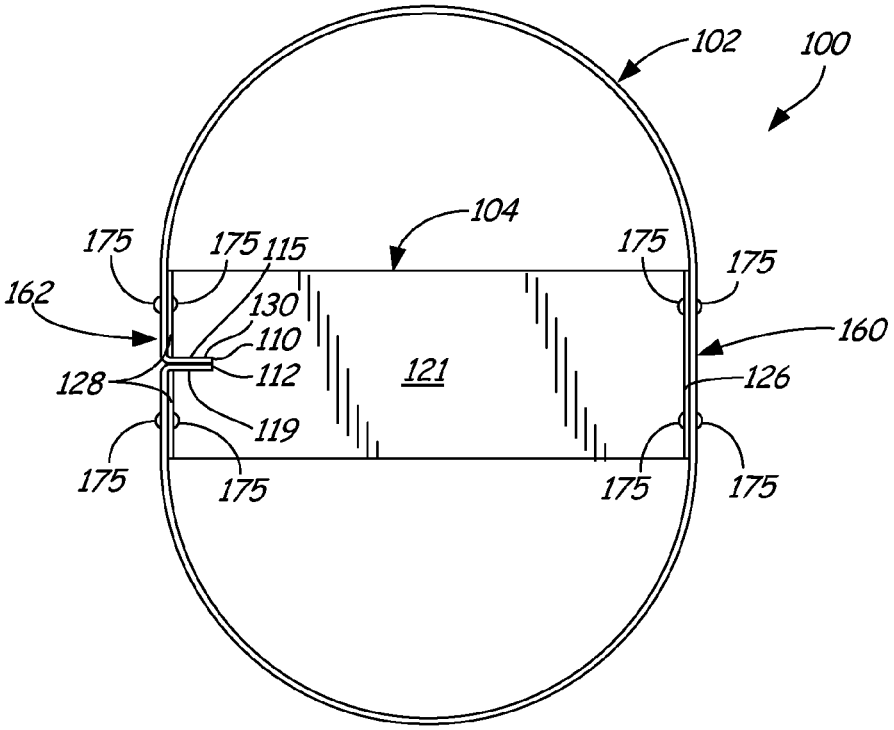
FIG. 9 is a top view of the clothing display fixture illustrated in FIG. 1.
Figure 10:
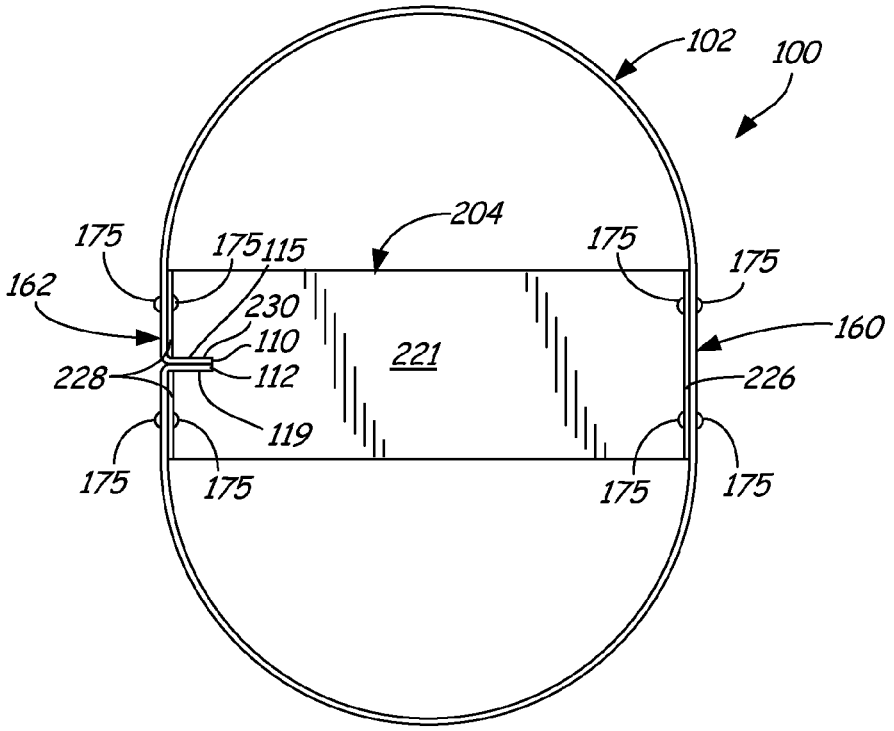
FIG. 10 is a bottom view of the clothing display fixture illustrated in FIG. 1.

As illustrated in FIGS. 1, 7 and 8, during the assembly of main body 102, the lower surfaces of attachment allowances 136, 142, and 143 of first support member 104 are coupled flush against the interior surface 103 of main body 102, while the upper surfaces of attachment allowances 236, 242, and 243 of second support member 204 are coupled flush against the interior surface 103 of main body 102. As illustrated in FIGS. 9 and 10, widthwise edges 128, 228 of first and second support members 104 and 204 and therefore also second attachment allowances 142, 242 and 143, 243 of first and second support members 104 and 204 span across the joint 117. In other words second attachment allowances 142, 242 on one side of joint 117 and second attachment allowances 142, 243 are on the other side of joint 117, while the joint 117 is located in slot portions 130, 230. Attachment allowances 136, 236; 142, 242; and 143. 243 of the support members 104, 204 are mounted to opposite sides of main body 102 such that the support members are traverse across a center of opening 165 of main body 102 and provide two planar sides 160 and 162 to the sleeve of main body 102. Planar sides 160 and 162 provide display surfaces for showing graphics on the clothing supported on the clothing display fixture 100.

As illustrated in FIGS. 2-4, main body 102, first support member 104 and second support member 204 all include apertures for receiving fasteners to secure attachment allowances 136, 236; 142, 242; and 143, 243 of first and second support members 104 and 204 to main body 102. Example fasteners include rivets, screws, etc. In one embodiment, attachment allowances 136, 236 of first and second support members 104 and 204 include two spaced apart apertures 144, 244, attachment allowances 142 and 143 of first support member 104 each include an aperture 146 and attachment allowances 242 and 243 of second support member 204 each include an aperture 246.

Main body 102 includes eight apertures. A first set of two apertures 150 (FIG. 2) includes one aperture located in proximity to first heightwise bend line 114 and the other aperture located in proximity to second heightwise bend line 118. Apertures 150 are configured to align with apertures 146 (FIG. 3) of first support member 104 to receive fasteners when the clothing display fixture 100 is assembled. A second set of two apertures 152 (FIG. 2) are located opposite from apertures 150 when the main body is assembled and are configured to align with apertures 144 (FIG. 3) of first support member 104 for receiving fasteners when the clothing display fixture 100 is assembled. A third set of two apertures 154 (FIG. 2) includes one aperture located in proximity to first heightwise bend line 114 and the other aperture located in proximity to second heightwise bend line 118. Apertures 154 are configured to align with apertures 246 (FIG. 4) of second support member 204 to receive fasteners when the clothing display fixture 100 is assembled. A fourth set of two apertures 156 (FIG. 2) are located opposite from apertures 154 when the main body is assembled and are configured to align with apertures 244 (FIG. 4) of second support member 204 for receiving fasteners when the clothing display fixture 100 is assembled.

As illustrated in FIGS. 7-9, first support member 104 is inserted into the main body 102 such that upper surface 121 faces upwards and widthwise edges 126 and 128 are bent above upper surface 121. Slot portion 130 of widthwise edge 128 receives attachment allowances 115 and 119. Apertures 144 of first support member 104 align with apertures 152 of main body 102 and apertures 146 of first support member 104 align with apertures 150 of main body 102. Fasteners 175 are received by apertures 144 and 152 and by apertures 146 and 150 to assemble first support member 104 to main body or sleeve 102. Therefore, attachment allowance 115 and 119 are held adjacent to each other by the attachment of first support member 104 to main body 102 by fasteners 175. As illustrated in the front and back views of FIGS. 5 and 6, first support member 104 is located a first height 184 from the bottom edge 108 of main body 102. The first height 184 is less than the height of first and second heightwise edges 110 and 112 of main body 102.

As illustrated in FIGS. 7-8 and 10, second support member 204 is inserted into main body 102 such that upper surface 221 faces upwards and widthwise edges 226 and 228 are bent below upper surface 221. Slot portion 230 of widthwise edge 228 receives attachment allowances 115 and 119. Apertures 244 of second support member 204 align with apertures 156 of main body 102 and apertures 246 of second support member 204 align with apertures 154 of main body 102. Fasteners 175 are received by apertures 244 and 156 and by apertures 246 and 154 to assemble second support member 204 to main body or sleeve 102. Therefore, attachment allowance 115 and 119 are further held adjacent to each other by the attachment of second support member 204 to main body 102 by fasteners 175. As illustrated in the front and back views of FIGS. 5 and 6, second support member 204 is located a second height 186 from bottom edge 108 of main body 102. The second height 186 is less than the first height 184 of first support member 104.

Figure 11:
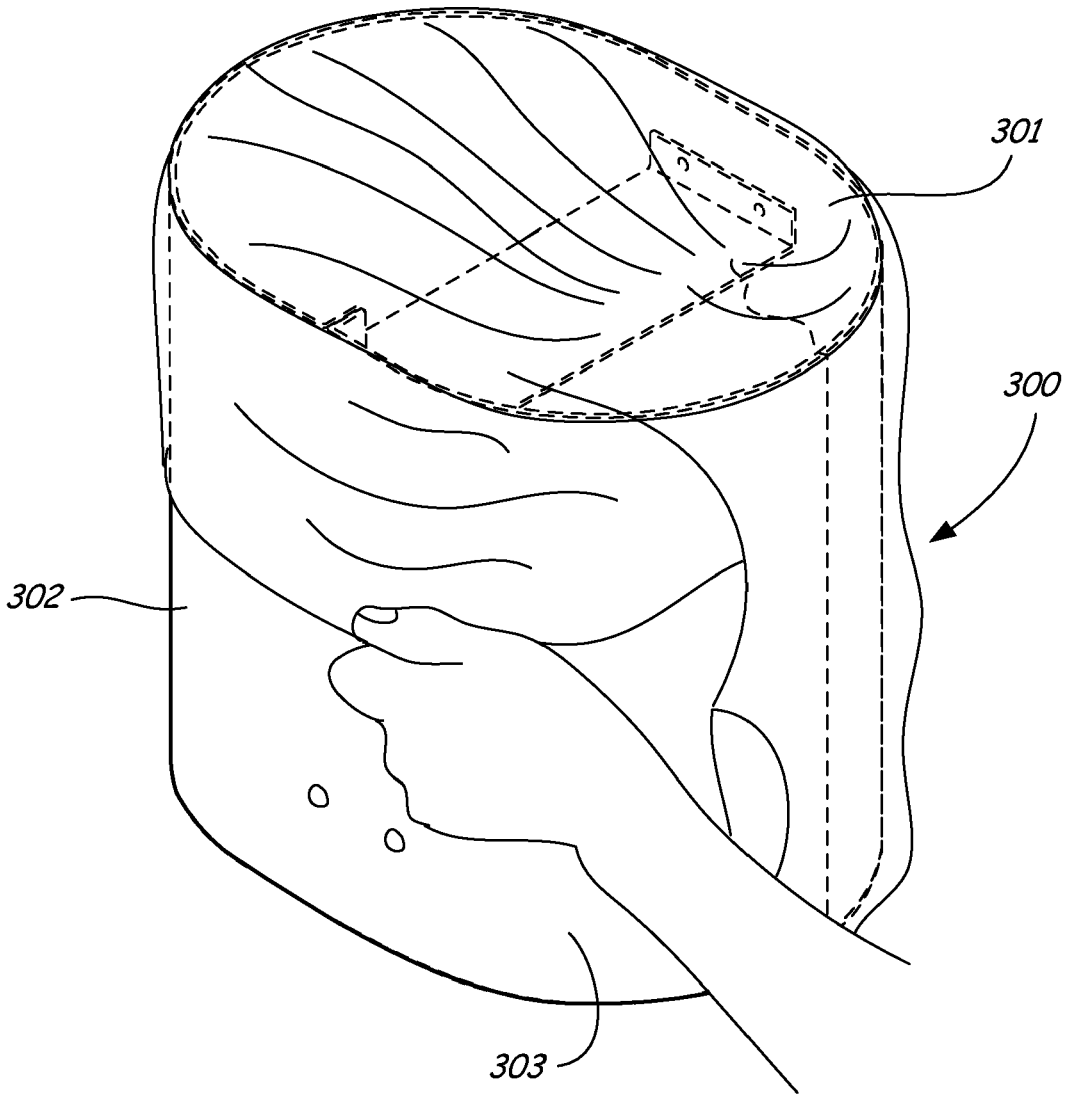
FIG. 11 is a perspective view of a tee shirt being installed on a clothing display fixture.
Figure 12:
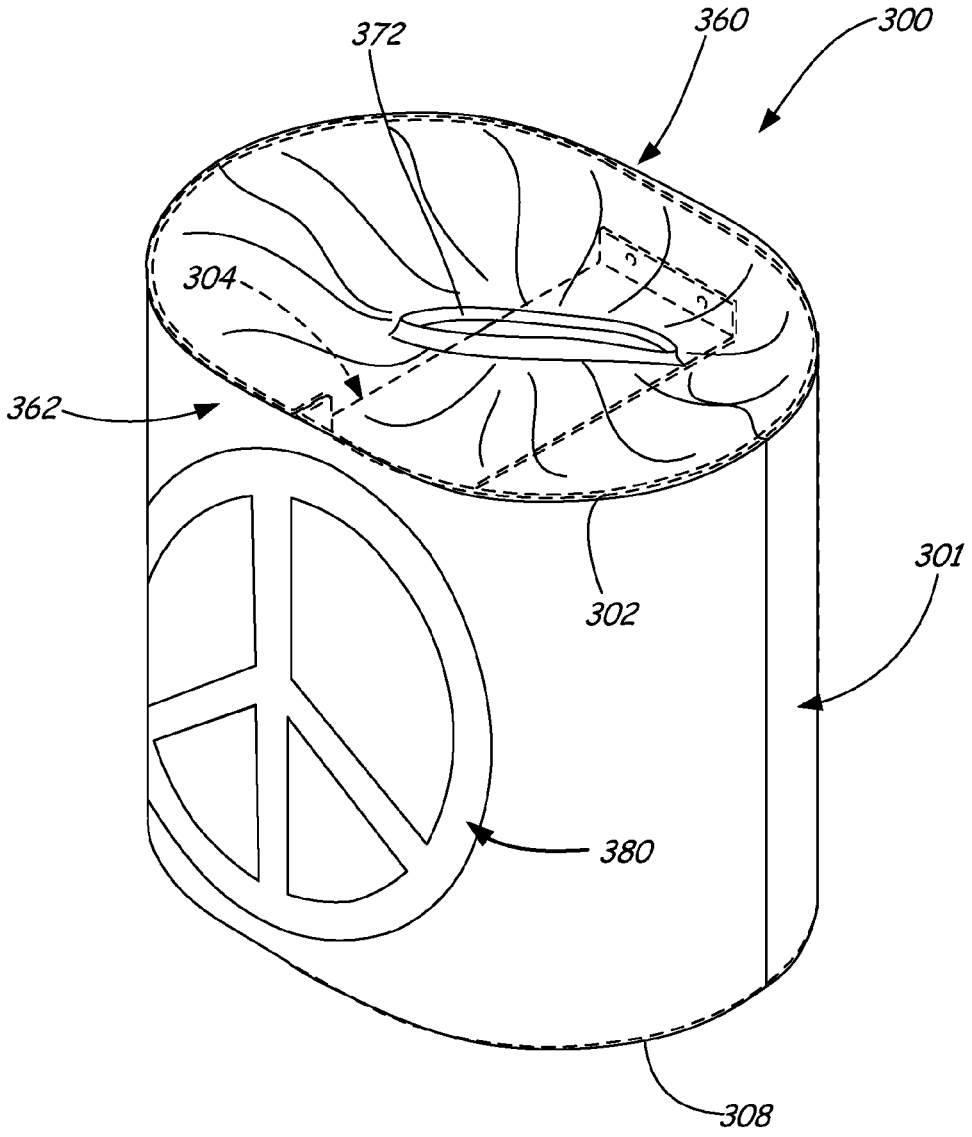
FIG. 12 is a perspective view of the tee shirt of FIG. 11 installed on the clothing display fixture under one embodiment.

FIG. 11 is a perspective view of a tee shirt 301 being installed on a clothing display fixture 300 under one embodiment. To install tee shirt 301 onto clothing display fixture 300, fabric of the tee shirt 301 is slid over the outer surface 303 of main body or sleeve 302 such that the tee shirt surrounds or covers the fixture and no part of the plastic sheeting is visible as illustrated in FIG. 12, which illustrates tee-shirt 301 installed on clothing display fixture 300. For example, the bottom edge of tee shirt 301 can wrap or tuck under bottom edge 308 of main body 302. Excess fabric of the tee shirt, such as the tee shirt sleeves 370 (FIG. 17) and the tee-shirt neck 372 can be tucked into the top opening of the fixture as defined by top edge 106 and supported by first support member 304.

Figure 13:
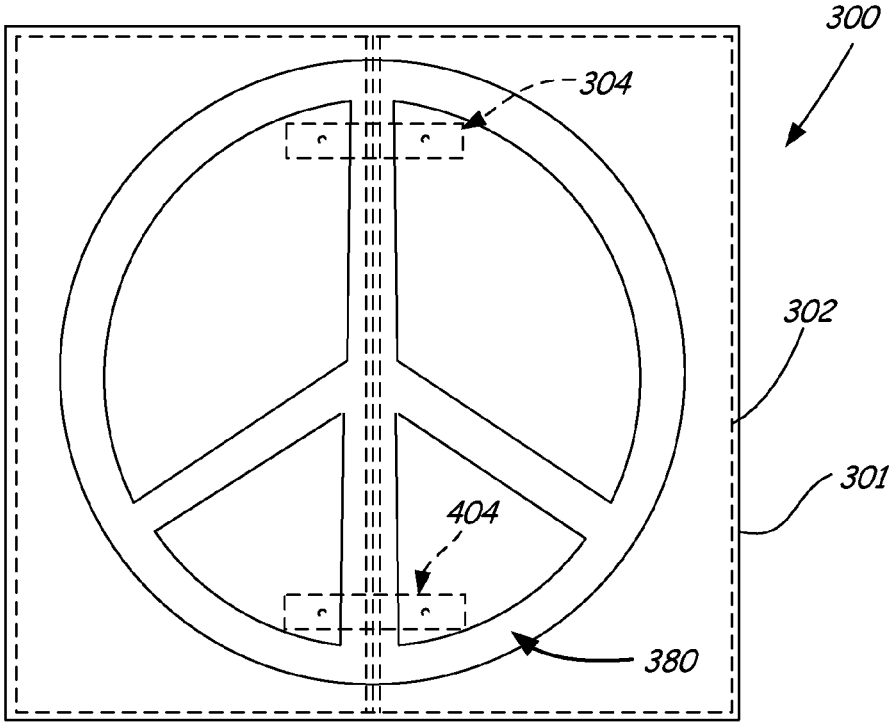
FIG. 13 is a front view of the clothing display fixture illustrated in FIG. 12.
Figure 14:
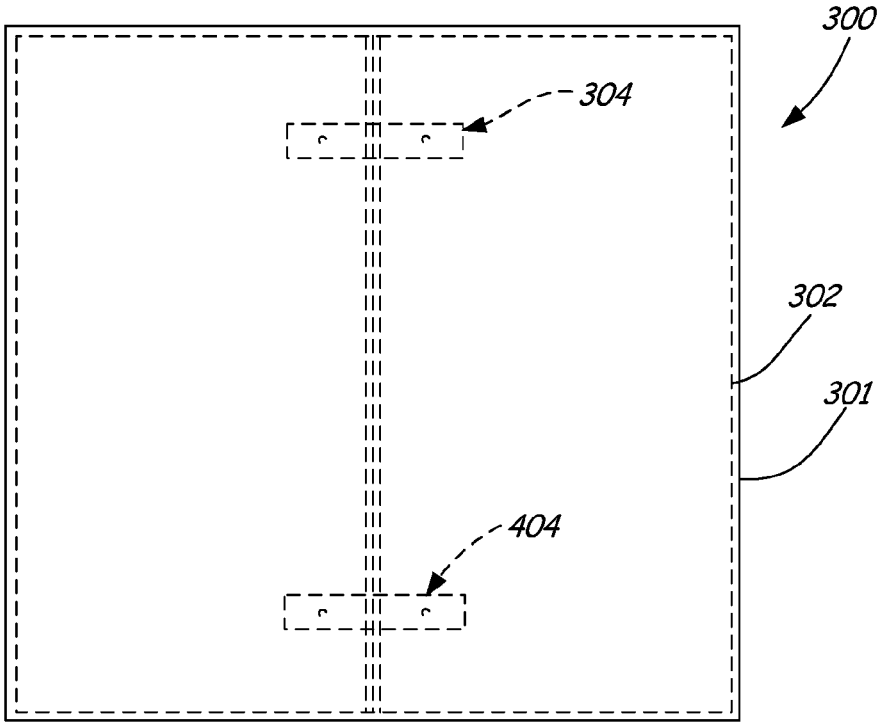
FIG. 14 is a back view of the clothing display fixture illustrated in FIG. 12.
Figure 15:
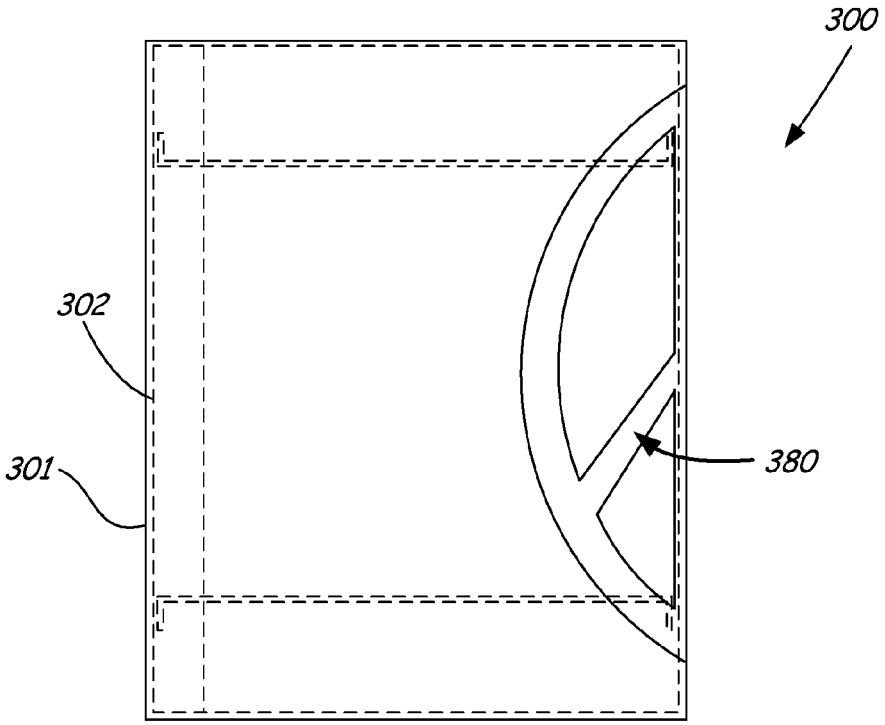
FIG. 15 is a left side view of the clothing display fixture illustrated in FIG. 12.
Figure 16:
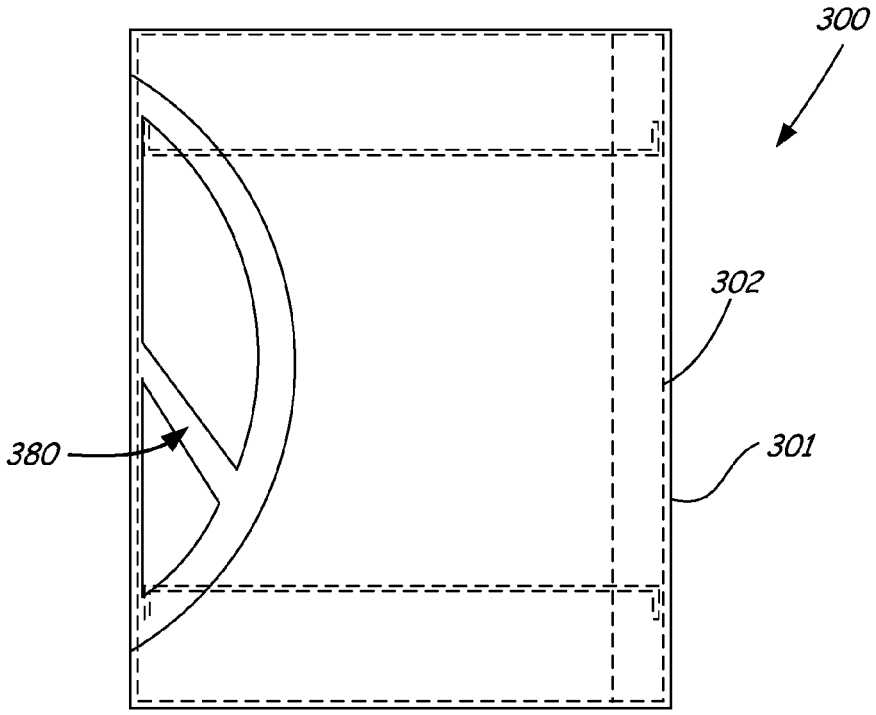
FIG. 16 is a right side view of the clothing display fixture illustrated in FIG. 12.
Figure 17:
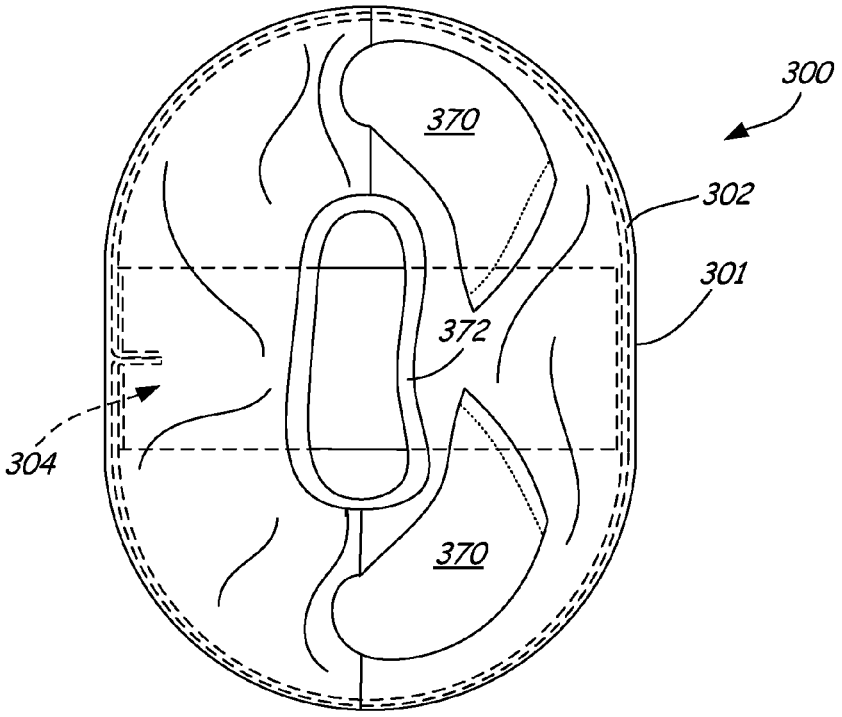
FIG. 17 is a top view of the clothing display fixture illustrated in FIG. 12.
Figure 18:
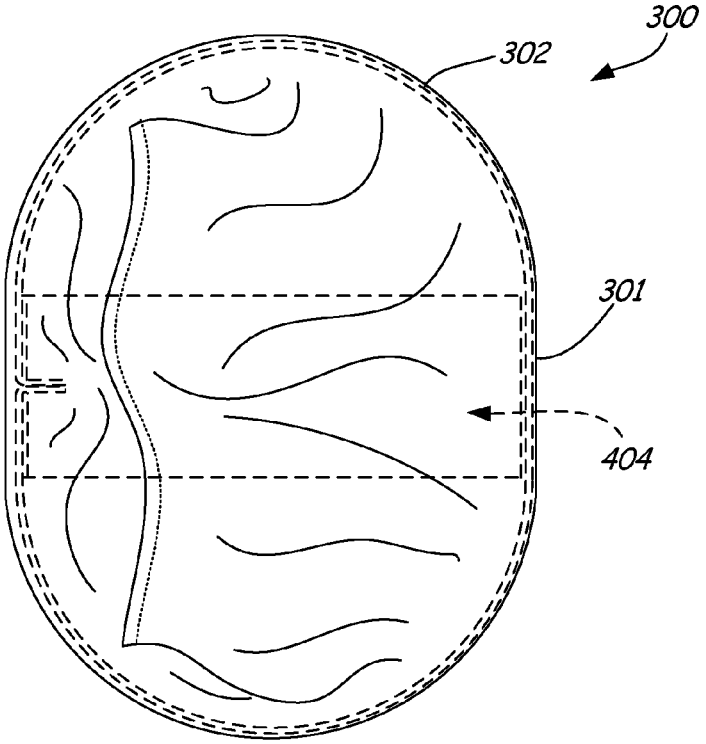
FIG. 18 is a bottom view of the clothing display fixture illustrated in FIG. 12.

FIG. 13 is a front view, FIG. 14 is a back view, FIG. 15 is a left side view, FIG. 16 is a right side view, FIG. 17 is a top view and FIG. 18 is a bottom view of the clothing display fixture 300 illustrated in FIG. 12. As illustrated in FIGS. 12, 17 and 18, planar surfaces 360 and 362 formed by first and second support members 304 and 404 assembled with main body 302 provides surfaces for displaying graphics on a piece of clothing. As illustrated, for example, a peace graphic 380 is located and displayed on the front of tee shirt 301. In particular, after covering tee shirt 301 on clothing display fixture 300, the tee shirt 301 and therefore the peace graphic 380 can be smoothed from a front of the fixture to a back of the fixture so that peace graphic 380 is wrinkle-free.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A product fixture comprising:

a sleeve having an inner surface, an outer surface, a pair of opposing edges defining a top and a bottom, a pair of opposing heightwise edges, and a joint; and a first cross member extending through a center of the sleeve and having a first lengthwise edge, an opposing second lengthwise edge, a first widthwise edge and an opposing second widthwise edge, the second widthwise edge including a slot portion;

wherein:

the first and second opposing widthwise edges are each located adjacent to the inner surface of the sleeve such that the second widthwise edge spans across the joint and the slot portion of the second widthwise edge accommodates the joint, the outer surface of the sleeve supports fabric of a piece of clothing, portions of the sleeve which are attached to the first and second widthwise edges of the first cross member comprise planar surfaces configured to display graphics on the fabric of the piece of clothing, the pair of opposing heightwise edges are positioned immediately adjacent one another such that the sleeve defines an internal cavity, the sleeve defines a pair of opposing bend lines each being offset from and extending parallel to the respective heightwise edge, and allowance portions of the outer surface of the sleeve each extend from one of the pair of opposing bend lines to the corresponding one of the pair of opposing heightwise edges inwardly into the internal cavity and are securely held flush with one another substantially continuously between the pair of opposing bend lines and the pair of opposing heightwise edges.

2. The product fixture of claim 1, further comprising a second cross member extending through the center of the sleeve having a first lengthwise edge, an opposing second lengthwise edge, a first widthwise edge and an opposing second widthwise edge, the second widthwise edge including a slot portion, wherein the first and second opposing widthwise edges of the second cross member are each located adjacent to the inner surface of the sleeve such that the second widthwise edge spans across the joint and the slot portion of the second widthwise edge accommodates the joint.

3. A product fixture comprising:

a sleeve having an inner surface, an outer surface, a pair of opposing edges defining a top and a bottom, and a joint; and a first cross member extending through a center of the sleeve and having a first lengthwise edge, an opposing second lengthwise edge, a first widthwise edge and an opposing second widthwise edge, the second widthwise edge including a slot portion;

wherein:

the first and second opposing widthwise edges are each located adjacent to the inner surface of the sleeve such that the second widthwise edge spans across the joint and the slot portion of the second widthwise edge accommodates the joint, the sleeve comprises a first attachment allowance defined by a first heightwise free edge and a first heightwise bend line intersecting with the pair of opposing edges of the sleeve and a second attachment allowance defined by a second heightwise free edge and a second heightwise bend line intersecting with the pair of opposing edges of the sleeve, and at the joint, an outer surface of the first attachment allowance and an outer surface of the second attachment allowance are coupled flush against each other substantially continuously between the first heightwise free edge and the first bend line to define the joint in a substantially linear manner.

4. A clothing display fixture comprising:

a main body having an interior surface, an exterior surface, a top edge, a bottom edge, and first and second heightwise edges that intersect with the top and bottom edges, wherein the first and second heightwise edges and opposing portions of the main body immediately adjacent each of the first and second heightwise edges are located adjacent together to define a joint and to form the main body, wherein the joint linearly extends into an interior of the main body;

a first support member having a first lengthwise edge, an opposing second lengthwise edge, a first widthwise edge and an opposing second widthwise edge, wherein the first and second opposing widthwise edges are each located adjacent to the interior surface of the main body such that the second widthwise edge spans across the joint and wherein the first support member extends through a center of the main body, the second widthwise edge includes a substantially linear slot, and the substantially linear slot receives the joint; and a second support member having a first lengthwise edge, an opposing second lengthwise edge, a first widthwise edge and an opposing second widthwise edge, wherein the first and second opposing widthwise edges are each located adjacent to the interior surface of the main body such that the second widthwise edge spans across the joint and wherein the second support member extends through the center of the main body.

5. The clothing display fixture of claim 4, wherein the first support member is located a first height from the bottom edge of the main body, the first height being less than a height of the first and second heightwise edges of the main body.

6. The clothing display fixture of claim 5, wherein the second support member is located a second height from the bottom edge of the main body, the second height of the second support member being less than the first height of the first support member.

7. The clothing display fixture of claim 4, wherein the main body further comprises a first heightwise bend line in parallel with and spaced apart from the first heightwise edge by a first distance to form a first attachment allowance and a second heightwise bend line in parallel with and spaced apart from the second heightwise edge by a second distance to form a second attachment allowance.

8. The clothing display fixture of claim 7, wherein at the joint, the exterior surface of the first attachment allowance is located flush against the exterior surface of the second attachment allowance substantially continuously across the first attachment allowance between first heightwise edge and the first heightwise bend line.

9. The clothing display fixture of claim 7, wherein a portion of each second widthwise edge of the first and second support members forms a slot portion for accommodating the first and second attachment allowances of the main body.

10. The clothing display fixture of claim 4, wherein the first support member comprises:

a first widthwise bend line in parallel with and separated by a first distance from the first widthwise edge to form a first support member attachment allowance; and a second widthwise bend line in parallel with the first widthwise bend line and separated by a second distance from a portion of the second widthwise edge to form a second support member attachment allowance positioned substantially continuously flush to and coupled with a substantially planar portion of the interior surface of the main body.

11. The clothing display fixture of claim 10, wherein the second support member comprises:

a first widthwise bend line in parallel with and separated by a first distance from the first widthwise edge to form a first support member attachment allowance;

a second widthwise bend line in parallel with the first widthwise bend line and separated by a second distance from a portion of the second widthwise edge to form a second support member attachment allowance; and wherein the second support member attachment allowances of the first and second support members, respectively, are coupled flush against the interior surface of the main body and span across the joint.

12. The clothing display fixture of claim 4, wherein the main body and the first and second support members comprise a plurality of apertures, wherein the apertures in the first and second support members align with apertures in the main body to receive fasteners.

13. A method of installing clothing on a product display fixture, the method comprising:

obtaining a product display fixture comprising:

a sleeve having an inner surface, an outer surface, a pair of opposing edges defining a top and a bottom, and a joint, a first cross member extending through a center of the sleeve and having a first lengthwise edge, an opposing second lengthwise edge, a first widthwise edge and an opposing second widthwise edge, the second widthwise edge including a slot portion, wherein:

the first and second opposing widthwise edges are each located adjacent to the inner surface of the sleeve such that the second widthwise edge spans across the joint and the slot portion of the second widthwise edge accommodates the joint, the sleeve comprises a first attachment allowance defined by a first heightwise free edge and a first heightwise bend line intersecting with the pair of opposing edges of the sleeve and a second attachment allowance defined by a second heightwise free edge and a second heightwise bend line intersecting with the pair of opposing edges of the sleeve, and at the joint, an outer surface of the first attachment allowance and an outer surface of the second attachment allowance are coupled flush against each other substantially continuously between the first heightwise free edge and the first bend line to define the joint in a substantially linear manner;

sliding clothing over and around the sleeve such that the clothing covers the outer surface of the sleeve; and tucking excess fabric of the clothing in an opening of the sleeve defined by the top.

14. The method of claim 13, wherein obtaining the product display fixture further comprises:

obtaining the product display fixture including a first cross member having a first lengthwise edge, an opposing second lengthwise edge, a first widthwise edge and an opposing second widthwise edge, wherein the first and second opposing widthwise edges are each located adjacent to the inner surface of the sleeve such that the second widthwise edge spans across the joint and wherein the first cross member extends through a center of the sleeve.

15. The method of claim 14, wherein obtaining the product display fixture further comprises:

obtaining the product display fixture including a second cross member having a first lengthwise edge, an opposing second lengthwise edge, a first widthwise edge and an opposing second widthwise edge, wherein the first and second opposing widthwise edges are each located adjacent to the inner surface of the sleeve such that the second widthwise edge spans across the joint and wherein the second cross member extends through the center of the sleeve.

16. The method of claim 15, wherein portions of the sleeve which are located adjacent the widthwise edges of the first and second cross members comprise planar surfaces for displaying graphics on the clothing.

17. The method of claim 13, further comprising smoothing fabric of the clothing from a front of the sleeve to a back of the sleeve to present a graphic on the clothing free of wrinkles.

18. The method of claim 13, further comprising tucking a bottom edge of the clothing under the bottom of the sleeve.

* * * * *